United States Patent [19]

Spencer et al.

[11] Patent Number: 4,609,801

[45] Date of Patent: Sep. 2, 1986

[54] CAVITY CONSTRUCTION FOR MICROWAVE OVEN

[75] Inventors: Donald J. Spencer, Pleasant Township, Franklin County; Leonard O. Larsen, Marion Township, Marion County, both of Ohio

[73] Assignee: Whirlpool Corporation, Benton Harbor, Mich.

[21] Appl. No.: 752,818

[22] Filed: Jul. 8, 1985

[51] Int. Cl.[4] ..... H05B 6/64

[52] U.S. Cl. ..... 219/10.55 R; 219/10.55 E; 126/273 R; 312/257 SM; 312/236

[58] Field of Search ..... 219/10.55 B, 10.55 R, 219/10.55 E, 400, 10.55 D; 126/273 R, 21 A, 21 R, 198; 312/257 SM, 257 R, 100, 236; 174/35 R

[56] References Cited

U.S. PATENT DOCUMENTS

| | | | |
|---|---|---|---|
| 1,075,369 | 10/1913 | Millice . | |
| 1,843,635 | 2/1932 | Taylor | 312/257 R |
| 1,909,136 | 5/1933 | Thomas, Jr. | 312/257 R |
| 2,798,781 | 7/1957 | Anderson | 312/257 R |
| 3,867,605 | 2/1975 | Yee | 219/10.55 D |
| 3,909,919 | 10/1975 | Miyabayashi et al. . | |
| 4,102,557 | 7/1978 | Lee et al. | 312/257 R |
| 4,162,380 | 7/1979 | Burke | 219/10.55 D |
| 4,192,431 | 3/1980 | Brown | 219/10.55 E X |
| 4,282,416 | 8/1981 | White | 219/10.55 R |

OTHER PUBLICATIONS

Enami Seiki Ad. Brochure, "Oven Cavity Curling Machine".

*Primary Examiner*—Philip H. Leung

*Attorney, Agent, or Firm*—Hill, Van Santen, Steadman & Simpson

[57] ABSTRACT

A cavity and cabinet construction for a microwave oven is provided which utilizes two U-shaped members which are nested together to form the cooking cavity and the cabinet. One member forms the front, bottom and rear panels of the cooking cavity and the cabinet and the other member forms the top panel and side panels of the cavity. The second member is laterally smaller than the first member to provide a chamber within the cabinet for housing the electrical components. The two members are secured together around the front panel by a metal crimping technique which prevents distortion and marking of the front face of the front panel and are joined along a bottom and rear edge by a metal stitching technique to secure the two members together in a radiation leak-proof manner. A U-shaped channel hinge bracket is utilized to provide support for a hinged door, the door having a hinge plate which sandwiches the flange of the front panel between the hinge plate and the hinge bracket. The hinge bracket is secured to the front panel and, at one location, to an adjacent side panel.

21 Claims, 14 Drawing Figures

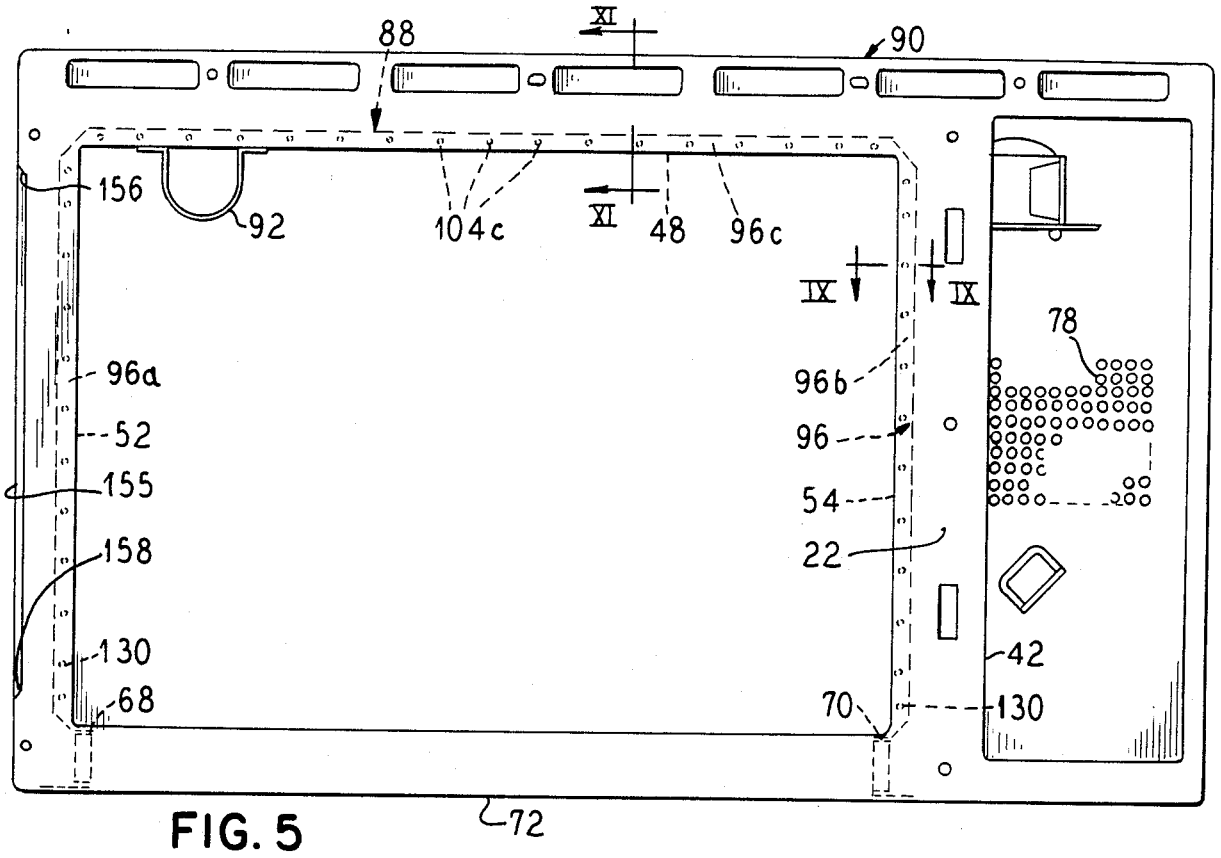
FIG. 5
FIG. 6
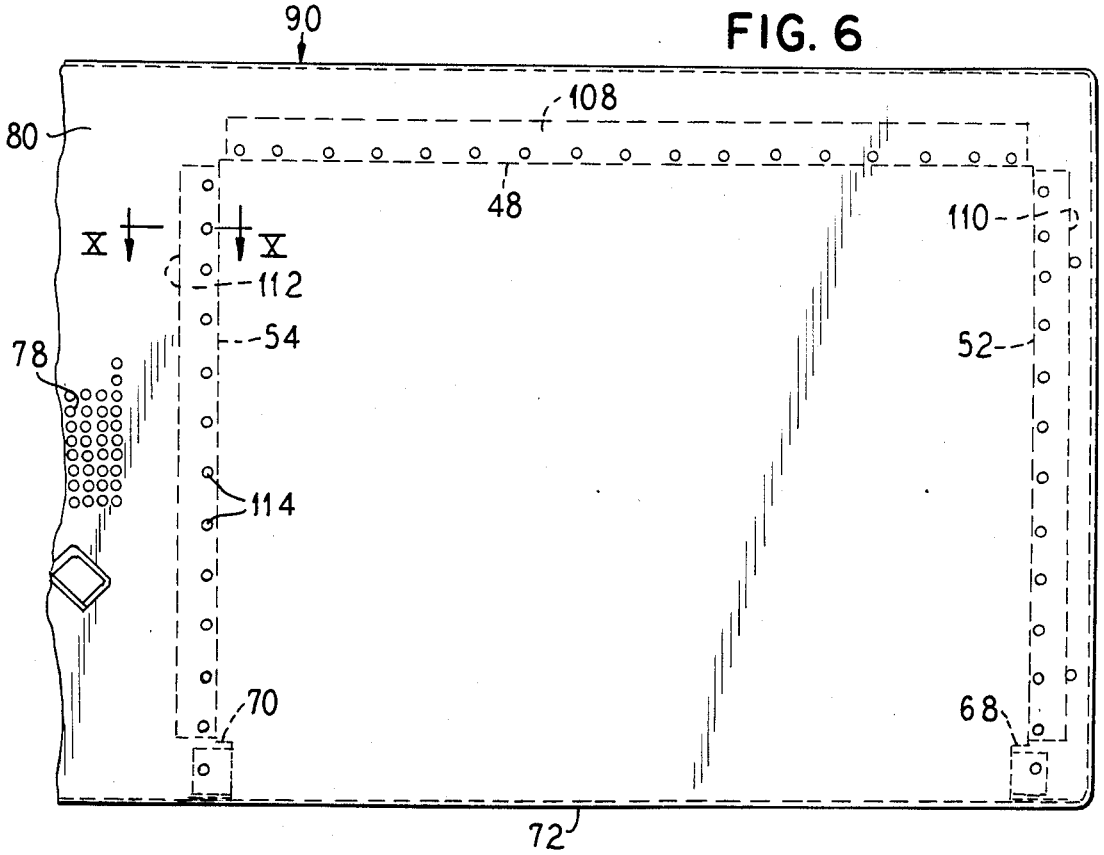

FIG. 7
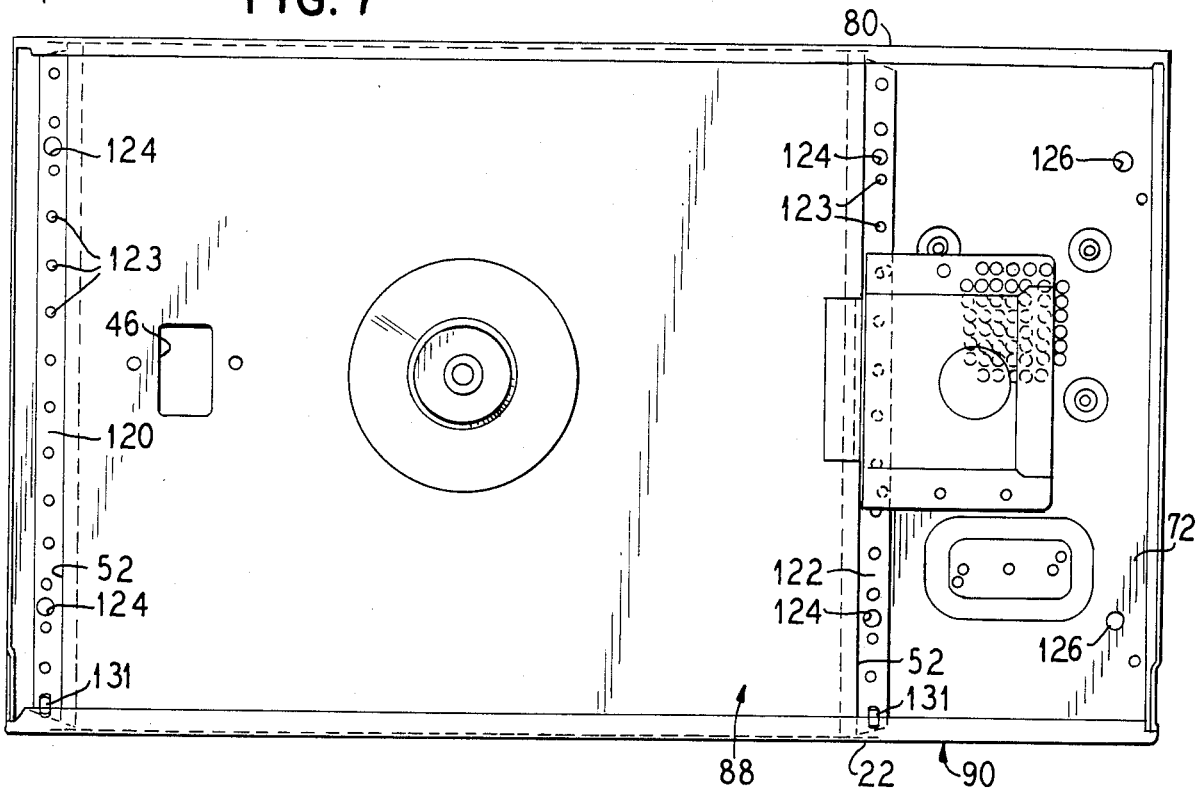
FIG. 8
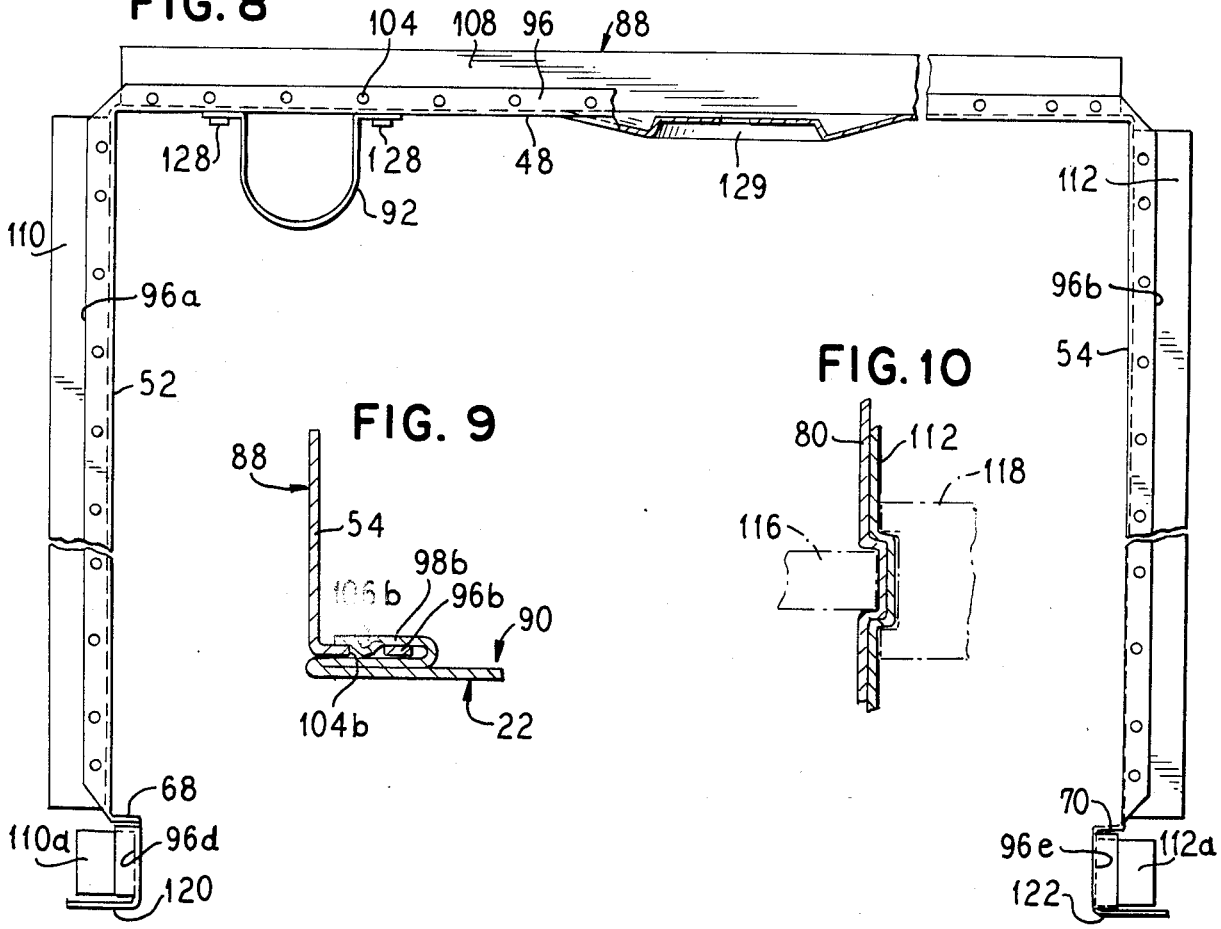
FIG. 9
FIG. 10

CAVITY CONSTRUCTION FOR MICROWAVE OVEN

BACKGROUND OF THE INVENTION

1. Field of the Invention

The present invention relates to microwave ovens and more specifically to the construction of the cooking cavity and cabinet for a microwave oven.

2. Description of the Prior Art

Microwave ovens designed for home and commercial use in heating food items require a carefully designed and constructed cabinet structure enclosing the cooking cavity in order to ensure uniform heating throughout the cavity and to avoid leakage of microwave radiation. Since the operator of such an oven must have easy access to the interior of the cavity, a door is generally provided on the front side of the cavity. To obtain a good door seal, the cabinetry around the front of the cavity must extend vertically and horizontally to provide a flat overlapping area for the door seal. Thus, the front cabinet panel is larger than the cavity opening and needs to define a front surface having a sufficient dimension around the cavity opening for a door seal to work properly.

In previous microwave cavity constructions, the panels defining the cooking cavity are generally joined by spot welding techniques in that a metal-to-metal contact is required to prevent the transmission and leakage of microwave radiation out of the cavity enclosure. Also, a smooth front surface surrounding the door is required for aesthetic purposes and thus many types of fasteners such as rivets and screws are not acceptable. The use of spot welds in microwave cavity construction causes the associated panels to move during fabrication due to the heating and cooling of the metal when the welds are formed. When individual side panels are utilized, the movement of the panels does not effect the resulting cabinet structure so much as when the panels are fabricated in a prejoined manner, such as by folding a large metal sheet.

Spot welding does create other problems in that it is a somewhat unreliable process which requires an increased number of individual spot welds to be factored into the design of the cabinetry construction to account for an occasional bad weld. Also, spot welds look unsightly on the front panel of the microwave oven causing that portion of the cabinet to be reworked by grinding or a similar operation prior to painting of the metal surface. Further, as described above, spot welding can distort parts locally causing puckers which also have to be mechanically removed, such as by grinding or by covering with an additional plate.

Some microwave cabinetry constructions utilize a metal crimping arrangement to attach adjacent panels, but because of the design of the crimps utilized, the minimum number of parts used to form the cooking cavity have been three. One reason for this is that because the entire front frame must have the ability to move in relation to the cavity to form the crimp. A fully crimped cavity design is now known which requires at least four plates or panel members. The plates are crimped together to form the cooking cavity. This construction further requires that a bottom panel and rear panel be added to form the oven cabinet.

Crimping has an additional advantage over spot welding in that it consumes much less energy since crimping only requires die pressure as opposed to the high voltage requirements for spot welding.

SUMMARY OF THE INVENTION

The present invention provides a microwave cavity and cabinet construction which utilizes two nested U-shaped sheet metal members to form the entire cavity and major cabinet portions of the microwave oven. Only a front door and decorative wrapper are required to be attached to complete the cabinet structure.

In some microwave ovens, the front panel is formed with a deep draw in order to provide an effective seal for the door. Such a construction requires a special draw quality steel which increases the cost of the cabinet. Further, such a construction would either require the use of a front panel separate from adjacent panels to minimize the increased cost, or would result in the use of the special steel in joined adjacent panels where its use is not necessary.

The cavity and cabinet construction of the present invention does not require a deep drawn front panel and therefore the expense associated with such a construction is avoided. A sufficiently large, flat sealing surface is provided around the perimeter of the cooking cavity opening on the front panel to provide a good seal for the door.

An interior one of the U-shaped members forms the two lateral side panels and top panel of the cooking cavity while the outer U-shaped member forms the front, bottom and rear walls of the cooking cavity as well as of the cabinet itself. Thus, additional sheet metal members are not required for the rear or bottom walls of the cabinet.

The outer U-shaped member extends laterally beyond one end of the inner U-shaped member providing space and mounting means for oven controls and the magnetron power supply components. The front panel of the outer U-shaped part has a suitable opening to provide access to the interior of the cooking cavity. The surrounding flat surface of the front panel provides a door sealing surface for containment of microwave energy.

Such a construction utilizing only two basic members makes a very efficient use of material and minimizes construction costs. The two U-shaped members are joined by metal crimping and stitching techniques which avoid the use of spot welding. This allows the cabinet to be constructed using simple press-brake tools for limited quantities or low capital investment and also permits construction by sophisticated automated tooling for economical production in large quantities.

The metal stitches are spaced less than $\frac{1}{4}$ wavelength apart to prevent the formation of gaps which would allow leakage of microwave radiation. The stitches provide a positive metal-to-metal contact which is required to prevent leakage. It is this metal-to-metal contact which is lost when a spot weld fails, which requires closer spacing of spot welds.

The joining of the two U-shaped members results in a strong cavity and cabinet construction and the cavity dimension is controlled to very close tolerances, better than by using individual panels with spot welding joints which include movement of the individual panels. Holding the cavity dimension to close tolerances is very important in maintaining consistency in cooking performance unit-to-unit in volume manufacturing, since cooking performance is directly related to the geometric configuration and dimensions of the cooking cavity.

It is known that in order to enhance the cooking performance within the cavity, the food items should be elevated above the bottom surface of the cavity and most microwave ovens incorporate a bottom shelf made of microwave transparent material which is elevated above the reflecting bottom wall by additional support members. The present cavity construction includes a built-in shelf support which avoids the requirement of the installation of additional separate shelf supports during the fabrication process.

The door of the cooking cavity is attached with a vertical hinge to a hinge bracket which sandwiches a flange at the side of the front panel for support. The hinge bracket is attached to the side panel at a single location which provides sufficient support for the door, including an external downward load on the door when it is opened. This uncomplicated hinge attachment compares with other microwave cabinet constructions which utilize multiple supports and numerous attachment points to adequately support the door.

DESCRIPTION OF THE DRAWINGS

FIG. 5 is a front view of the cavity and cabinet assembly.

FIG. 6 is a rear view of the cavity and cabinet assembly.

FIG. 7 is a top view of the cavity and cabinet assembly.

FIG. 8 is a front view of the inner U-shaped member.

FIG. 9 is a side sectional view of the front flange joint.

FIG. 10 is a sectional view of the rear flange joint.

DESCRIPTION OF THE PREFERRED EMBODIMENT

Figure 1:
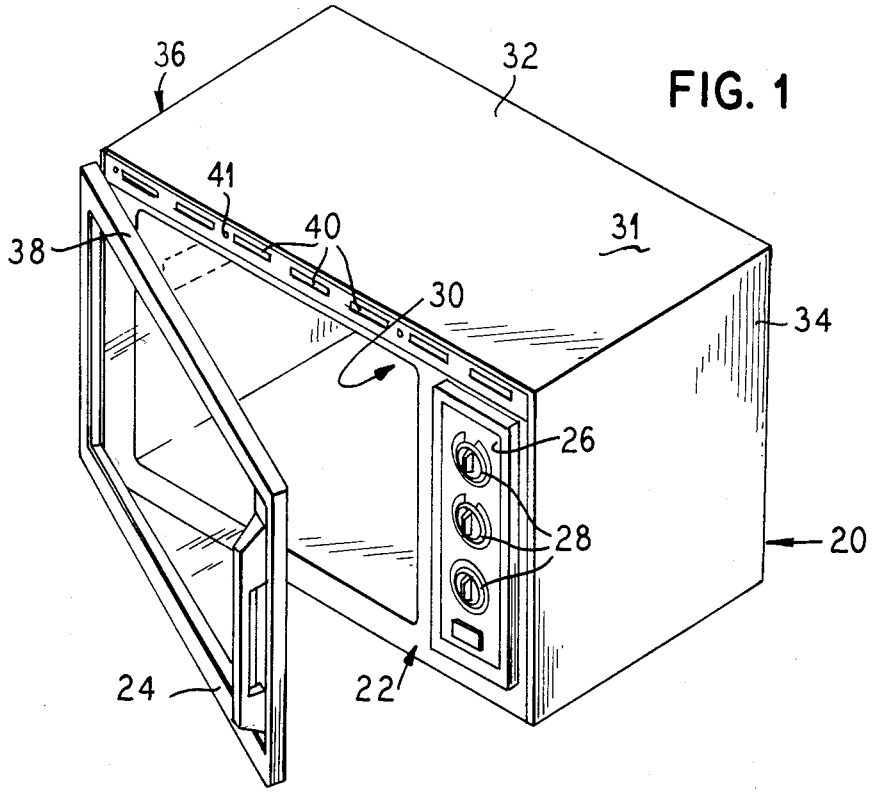
FIG. 1 is a perspective view of a microwave oven embodying the principles of the present invention.

In FIG. 1 there is seen a microwave oven generally at 20 having a front panel 22 with an openable hinged door 24 having a generally transparent central area 25 and a control panel 26 with a plurality of controls 28 for setting the parameters of the heating cycle to be performed by the oven. The hinged door 24 opens to expose a cooking cavity 30.

A removable wrapper 31 forms a finished and aesthetically pleasing appearance for a top outer surface 32 and opposed end outer surfaces 34, 36 of the microwave oven cabinet. Located on the front panel 22 above a top edge 38 of the door 24 are a plurality of air vents 40 which provide an exit opening for air which is forced through the interior of the oven 20. A removable exhaust grill 41 covers the air vents 40 resulting in a pleasing appearance of the front panel 22.

Figure 2:
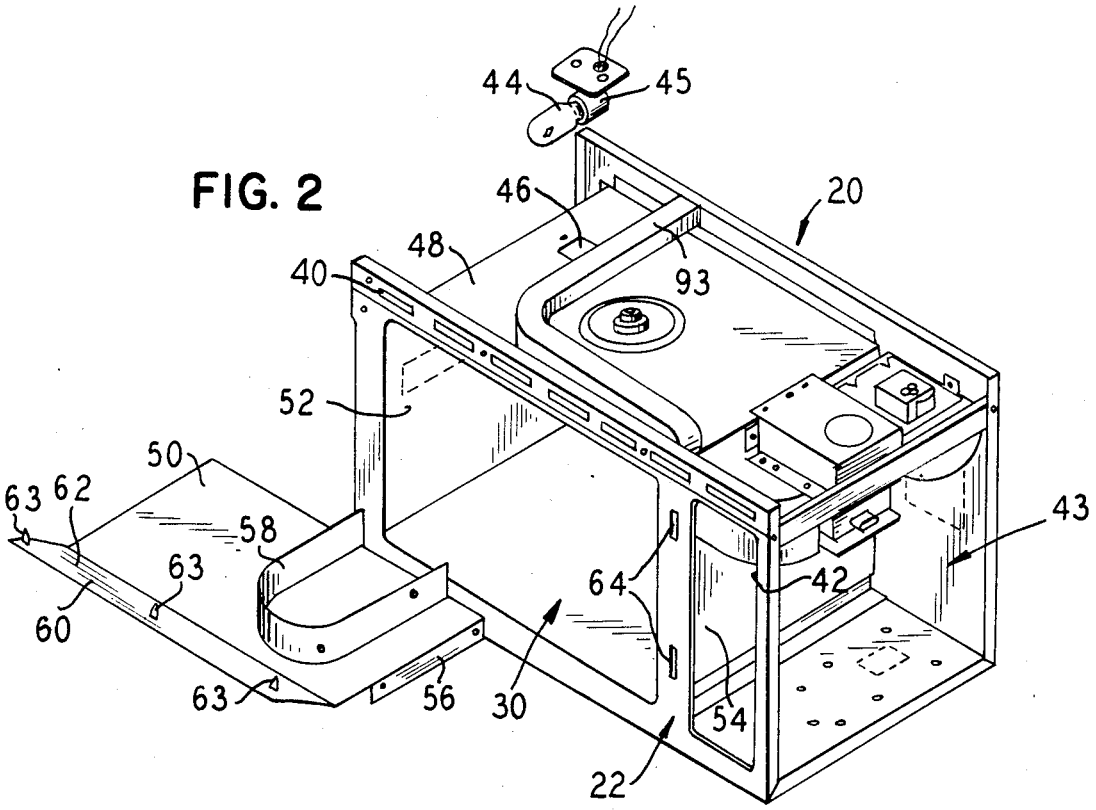
FIG. 2 is a perspective exploded view of the microwave cabinet of FIG. 1.

In FIG. 2, outer portions of the microwave oven 20 have been removed, such as the wrapper 31, the door 24 and the control panel 26. It is seen that the front panel 22 has an opening 42 to provide access for the rear portions of the controls 28 to extend into a chamber 43 which houses substantially all of the electrical components for the microwave oven. Also, a number of electrical components have been removed from the interior of the cabinet behind the control panel area. Shown in an exploded form are a light bulb 44 and socket connection 45 which normally are located in the interior of the cooking cavity 30 and are inserted through an opening 46 in a top panel 48 of the cooking cavity.

Also shown in an exploded manner is a protective cover 50 which is placed within the cooking cavity 30 and is made of a translucent material to permit light to shine through the cover 50 to the interior of the cooking cavity 30. The cover 50 attaches to a pair of opposed side panels 52, 54 of the cooking cavity by means of flanges 56 on the edges of the cover so that an upstanding wall 58 on the top side of the cover 50 abuts against the top wall 48 of the cooking cavity 30. The wall 58 surrounds a paddle (not shown) which is used to "stir" the microwave energy entering the cooking cavity to enhance the distribution of that energy.

A front panel 60 of the cover 50 is hinged at 62 and is provided with a plurality of locking tabs 63 so that it can be selectively opened downwardly to provide access to the light bulb 44 for changing purposes without necessitating the removal of the entire cover 50. Thus, the paddle is continuously protected by the upstanding wall 58 even while the user changes the light bulb 44. The locking tabs 63 snap into small openings in the top panel 48 of the cooking cavity 30.

Two small apertures 64 are provided in the front panel 22 between the cooking cavity opening and the control panel opening 42. These small openings 64 provide access for latch members of the door.

Figure 3:
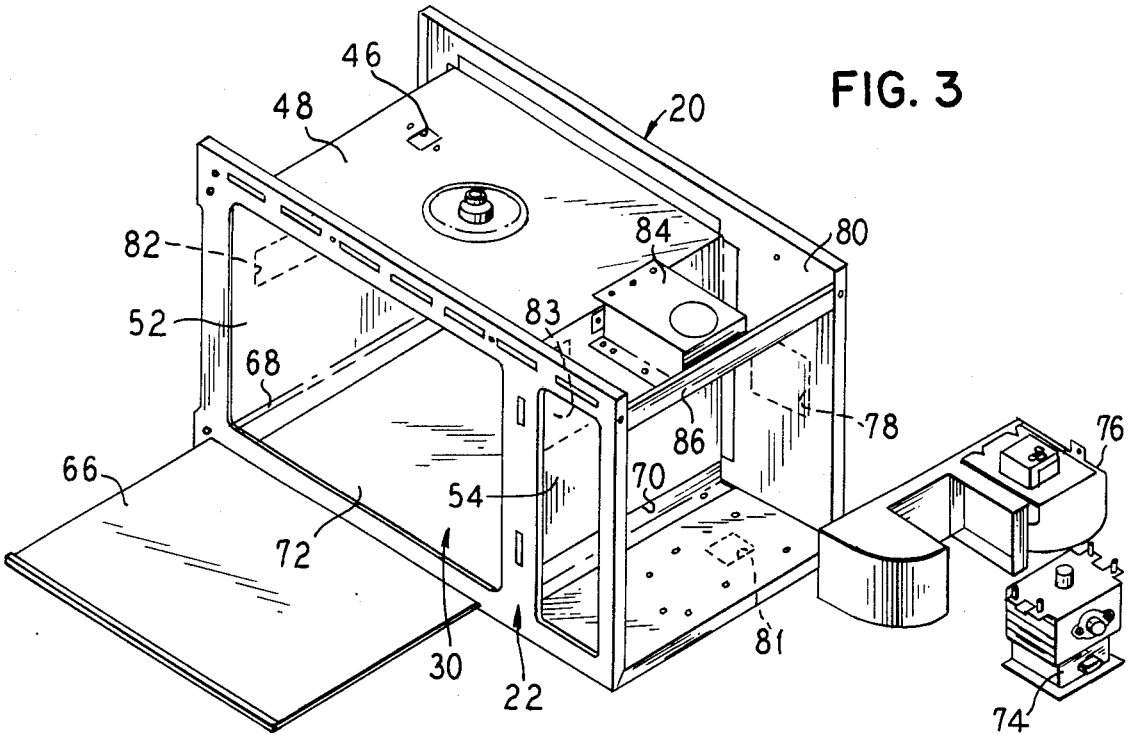
FIG. 3 is a perspective further exploded view of the microwave oven cooking cavity and cabinet with the support shelf removed.

In FIG. 3 the microwave oven 20 is shown in a further disassembled condition and it is seen that there is a shelf member 66 which normally forms a false floor of the cooking cavity 30. The side panels 52, 54 are each formed with a ledge 68, 70 respectively, therein, by appropriate bending of the sheet metal panels, which supports the shelf 66 above a bottom panel 72 of the cooking cavity 30.

The shelf 66 is formed of a microwave transparent material and it is used to hold food items above the bottom panel 72 of the cooking cavity so that microwave energy can be reflected off of the bottom panel 72 and can enter the food items from below as well as from all other sides.

Other elements shown partially disassembled in FIG. 3 are a magnetron 74 which produces the microwave energy and a fan and air duct housing 76 which is used for drawing air into the microwave oven cabinet through an opening 78 formed in a rear panel 80 of the oven and an opening 81 formed in the bottom panel 72 to cool the magnetron 74 and other electrical components.

There are also shown air vent openings 82 and 83 in side panels 52 and 54 respectively. These openings permit air to flow through the interior of the cooking cavity 30 to flush the interior of the cooking cavity and also to wash the inside of the door 24 to permit viewing through the transparent portion of the door without the build-up of condensation on the door.

A wave-guide 84 is shown attached to the side panel 54 of the cooking cavity and to a brace 86 which connects the front panel 22 with the rear panel 80. The wave-guide 84 directs the microwave energy from the magnetron 74 to the interior of the cooking cavity 30.

Figure 4:
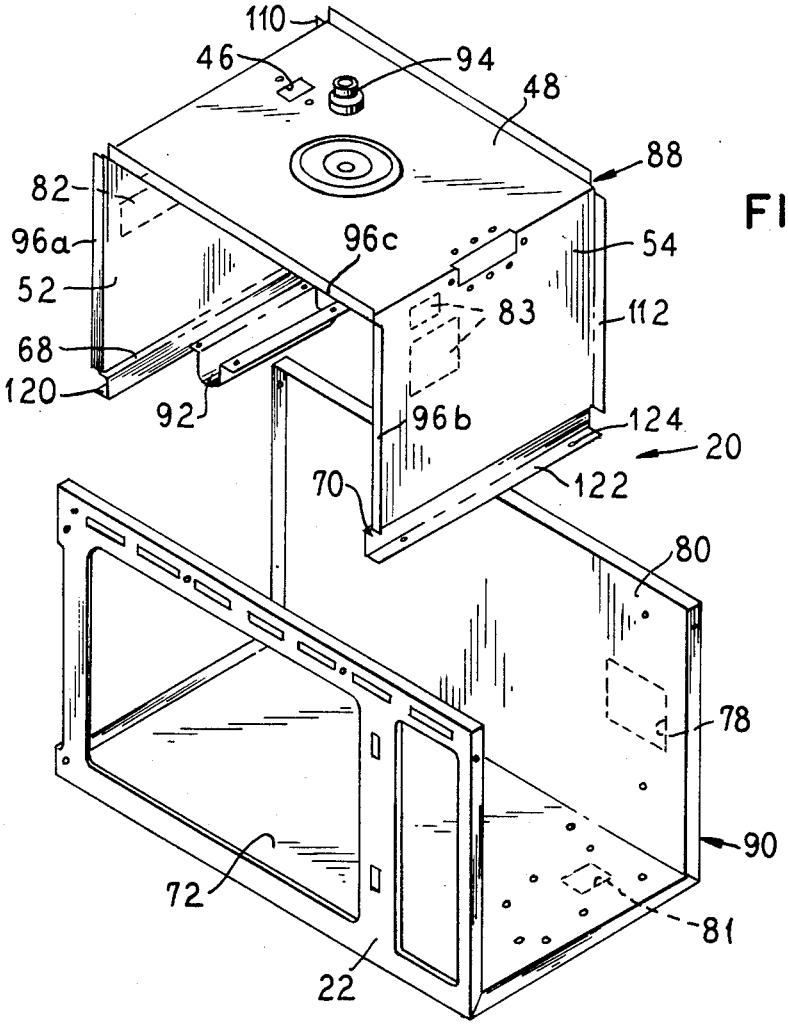
FIG. 4 is a perspective exploded view of the two U-shaped members.

FIG. 4 shows a final disassembly of the microwave oven 20 showing that the basic cooking cavity is constructed of two U-shaped sheet metal members 88, 90. The inner member 88 comprises the top panel 48 and two side panels 52, 54 of the cooking cavity while the outer member 90 forms the rear panel 80, the front panel 22 and the bottom panel 72. The two U-shaped members are nested together so that all six sides of the cooking cavity are formed by the two members and also the cabinet is divided to provide the control chamber 43 within the cabinet without the addition of extra panel members.

The width of the top panel 48 is less than the width of the bottom panel 72, front panel 22 and rear panel 80, thus providing the chamber 43 adjacent the cooking cavity 30 separated from the cooking cavity by the side panel 54. The chamber 43 provides the space necessary to house all of the electrical components and controls necessary to effect the generation and control of the microwave radiation energy. No additional panel members are required to be used or assembled to form the electrical component chamber 43.

Figure 11:
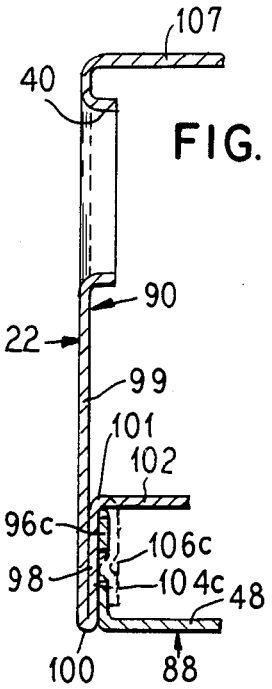
FIG. 11 is a sectional view of the outer U-shaped member flange prior to crimping with the crimped position shown in phantom.

The height of the side panels 52, 54 is less than the height of the front panel 22 and rear panel 80 thus providing a space between the top panel 48 and the wrapper 31 forming a portion of the air ducting system which communicates with the air vents 40. Referring back to FIG. 2, an air baffle 93 is shown as extending along a portion of the top of the top panel 48 between the front panel 22 and the rear panel 80. This baffle extends fully between the top panel 48 to the wrapper 31, when assembled, to separate high and low pressure zones within the air circulation system for the microwave oven. In FIG. 11, it is clearly seen that the front wall 22 has a rearwardly extending flange 107 at a top end thereof which forms a top resting surface for the outer cabinet wrapper 31. The rear panel 80 has a similar forwardly extending flange.

Also shown in partial disassembly in FIG. 4 is a shield 92 which covers the light bulb 42 and which attaches directly to the bottom side of the top panel 48 of the cooking cavity. Also shown disassembled is a drive hub 94 for the paddle which is positioned above the top panel 48.

FIG. 5 is a front view of the assembly of the two U-shaped members 88, 90 which illustrates that the front of the inner member 88 has a flange 96 with portions **96*a* and 96*b* extending along a front edge of each of the side panels 52, 54 and a portion 96*c* across an extending front edge of the top panel 48. A special metal crimping technique is utilized to hold the flange 96 against the front panel 22** of the cooking cavity to prevent unsightly fasteners and welding dimples.

FIG. 11 is a sectional view taken through the top portion of the front panel 22 of the cooking cavity where it is seen that the front panel 22 just below the air exit openings 40 has a flange 98 which first folds back against a back side 99 of the front panel 22 at a sharp bend 100 which defines the edge of the cooking cavity opening. The flange 98 has a 90° bend 101 formed therein with a portion 102 extending rearwardly. This rearward portion 102 is crimped down over the flange **96*c* formed along the top edge of the top panel 48 of the inner member to overlie and completely cover that flange 96*c* as shown in phantom at 102*a***.

The flange portion **96*c* of the inner member 88 has a plurality of equally spaced holes 104*c*, and a plurality dimples 106*c* are pressed into the portion 102 of the front panel flange 96 which overlaps and captures the top panel flange 96*c*, directly over the spaced holes 104*c*. When this is done, the top panel flange 96*c* is securely captured by the front panel flange 98** and is prevented from moving in any direction.

A similar crimping connection technique is used for the flanges **96*a* and 96*b* extending along the front edge of the side panels 52, 54 as is shown in FIG. 9. The flange portion 96*b* of the side panel 54 is captured by a flange 98*b* of the front panel 22 after that flange 98*b* has first been folded back upon itself and then reverses direction again to overlie the side panel flange 96*b*. A plurality of dimples 106*b* are formed to be captured in the spaced openings 104*b*** to securely lock the two flanges together.

The spacing of the openings 104 in the flange 96 is critical in that it must be no greater than ¼th of a wavelength in order to prevent leakage of microwave energy. The wavelength of the microwave energy used in typical microwave ovens is 12.64 centimeters (approximately 5") so a spacing of approximately 2½ centimeters (approximately 1") would satisfy the requirements. The metal crimping technique described not only provides a positive connection preventing movement of the two parts, it also provides a metal-to-metal contact necessary to prevent the leakage of the microwave energy.

Further, the metal crimping technique permits the front surface of the front panel 22 to remain unmarked to provide a pleasing aesthetic appearance of the front panel of the cabinet around the door opening without the necessity of reworking of the front surface after the connection has been made between the panels. The metal crimping technique utilized to assemble the front panel of the outer member 90 to the inner member 88 also has the advantage that it can be performed by relatively simple press-brake machines as well as sophisticated computer controlled punch press equipment. Therefore, the assembly of the front portion of the cavity can be done by either relatively simple machinery to permit assembly by relatively unsophisticated methods or, it can be constructed economically in large quantities very rapidly by using relatively sophisticated machinery.

FIG. 6 shows a rear view of the back panel 80 of the outer member 90 which shows in phantom that the back edge of the top panel 48 has a flange 108, the back edge of the side panel 52 has a flange 110 and the back edge of the side panel 54 has a flange 112. These flanges lie directly against the back panel 80 and are secured to the back panel by a metal stitching technique. Since the aesthetic appearance of the back panel from the back side of the microwave oven is not critical, a metal stitching technique which leaves a row of spaced dimples 114 is used. This stitching technique is shown in FIG. 10 where an exemplary portion of the flange 112 is shown overlying the back panel 80. A punch member 116 and a die member 118 are placed on opposite sides of the two overlying panels and the punch 116 is forced against the back panel 80 urging the two portions to be deformed into the die 118. A further step is performed in which the extruded portions are swaged over so that a positive lock is provided between the flange 112 and the back panel 80. This stitching operation is performed along the length of the flanges 108, 110 and 112, again at spaced intervals of less than ¼th of a wavelength.

It should be evident that this metal stitching technique can also be performed by relatively simple punch press machinery as well as sophisticated computer controlled machinery to provide the same assembly advantages as described above with respect to the stitching technique utilized for the front edge of the member assembly. Thus, by using the two metal attachment techniques described, the two U-shaped members can be securely fastened together in a radiation leak-proof manner thus forming the entire cooking cavity without the need for additional fasteners or welding techniques. The two members are formed together in a secure and sturdy manner to provide a relatively rigid structural assembly to hold all of the components of the microwave oven.

FIG. 7 is a top plan view of the assembled members 88, 90 which shows in detail the connection between the two members along the bottom panel 72. It is seen that the side panels 52, 54 have flanges 120, 122 respectively which extend from the front panel 22 to the rear panel 80. The flanges 120, 122 are connected to the bottom panel 72 by the same metal stitching technique as is used to attach the rear flanges 108, 110 and 112 to the back panel. A row of spaced dimples 123 representing the stitches are shown. Four alignment holes 124 are provided in the flanges 120, 122 to ensure that the two members 88, 90 are assembled in a predetermined alignment. The two left-most alignment holes 124 are later used to receive studs for mounting feet for the oven. Two other mounting studs are received in openings 126 formed in the bottom panel 72 near the right edge of the bottom panel.

FIG. 8 shows a partial front view of the inner member 88. Here the front flange **96*c* and the rear flange 108 of the top panel 48 are clearly shown. The front flange 96 has the spaced openings 104*c* along its length. As discussed above, the lamp shield 92 attaches directly to the top panel 48 by appropriate fastening means 128 such as sheet metal screws. The microwave stirring paddle (not shown) is mounted onto a boss 129 which is formed directly in the top panel 48. The rear flange 108 is substantially wider than the front flange 96*c***.

The front flanges **96*a* and 96*b* respectively and the rear flanges 110 and 112 of the side panels 52 and 54 are also clearly shown. Again, the rear flanges 110, 112 are substantially wider than the front flanges 96*a*, 96*b*. The ledges 68, 70 which are preformed near the bottom edge of the side panels 52, 54 are also clearly shown. It is also clearly seen here that the portion of the side panels 52, 54 below the ledges 68,70 are provided with front flanges 96*d* and 96*e* as well as rear flanges 110*a* and 112*a***.

Referring again to FIG. 6, it is seen that the flanges **110*a* and 112*a* are secured to the rear panel 80 by the metal stitching technique. However, by referring to FIG. 5, it is seen that the flanges 96*d* and 96*e* are not crimped to the front panel 22, since there is no corresponding front panel flange. Thus, unavoidably, there is a gap between a bottommost crimp connection 130 of the front side flanges 96*a* and 96*b* to a foremost stitch 131 of the bottom flanges 120, 122. This gap is somewhat greater than ¼th of a wavelength, but tests performed by the Applicants indicate that any radiation leakage at these points is well below the Federally established permissible leakage rates. It is believed that leakage is low in these areas due to the polarization of the microwave energy as it enters the cooking cavity, along with the configuration and orientation of the gap presented. The small front flanges 96*d* and 96*e*** are provided to extend across the gap and it is believed that they tend to reduce the possibility of leakage of microwave energy from the cooking cavity.

From the foregoing description it should be clear that the entire peripheral edge of the inner member 88 is provided with a flange formed at 90° to its associated panel to lie flat against adjacent portion of the outer member 90 to provide the crimped and stitched connection to the outer member 90. Thus, the microwave energy is safely contained within the cooking cavity.

Figure 13:
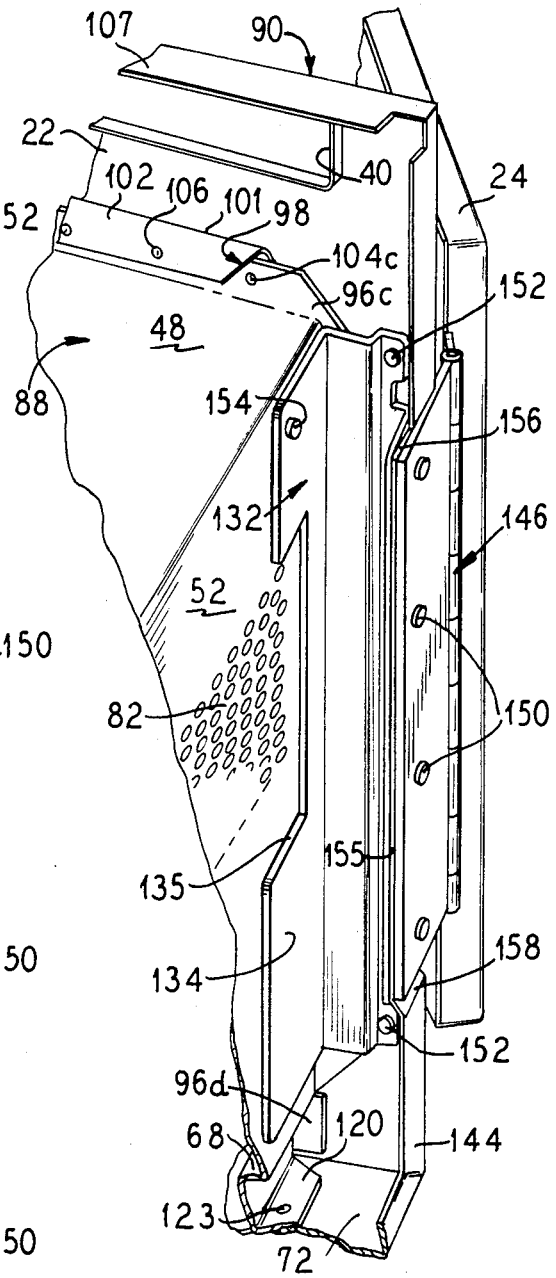
FIG. 13 is a perspective view of the hinge and crimped area of the front of the cabinet.

FIG. 13 is a rear perspective view of the hinge area between the door 24 and the front panel 22. The crimping technique for the front portion of the inner member 88 to the outer member 90 is clearly shown. The top panel 48 has the flange portion **96*c* extending upwardly therefrom which has the openings 104*c* therein. The front panel 22 has the flange 98 with the portion 102 which overlies the top panel flange 96*c* and has the dimples 106 formed therein to securely lock into the openings 104*c***.

The bottom flange connection is also shown where it is seen that the flange member 120 of side panel 52 overlies a portion of the bottom panel 72 and the metal stitches 123 are formed therein to secure the two panel portions together.

Figure 12:
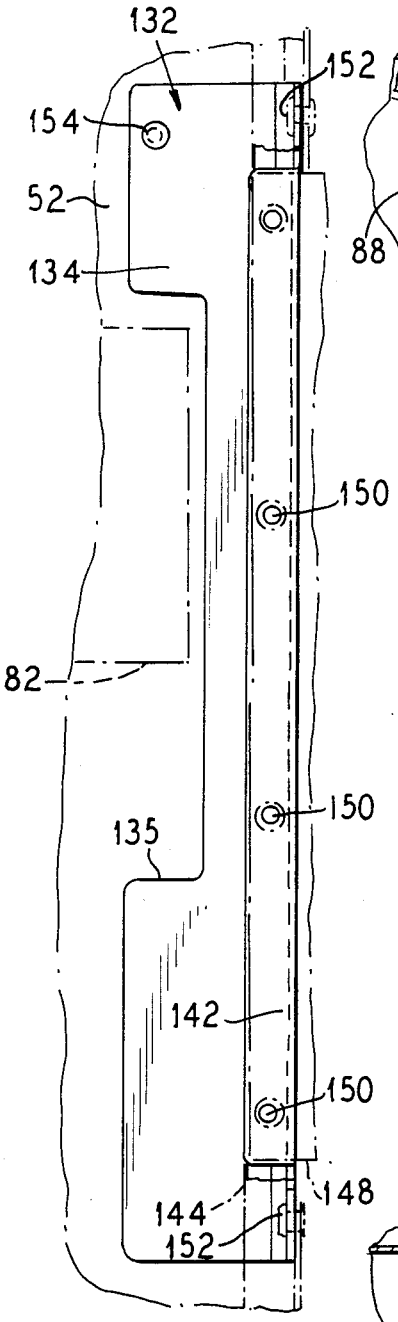
FIG. 12 is a side view of the hinge support bracket.
Figure 14:
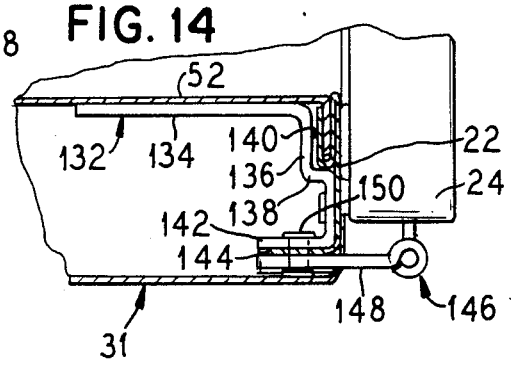
FIG. 14 is a top sectional view of the hinge support bracket.

The hinge support is shown in FIGS. 12–14 where it is seen that there is a hinge bracket 132 which comprises a generally U-shaped channel member with one tall upstanding leg 134 of the U lying against the outside surface of the side panel 52. A bottom portion 136 of the U is stepped at 138 to provide a clearance area 140 for the flange connection between the side panel 52 and the front panel 22, as well as a direct connection between the bottom U-shaped portion 136 to the front panel 22. A second shorter upstanding leg 142 lies against an inside surface of an outer side flange 144 of the front panel 22. A portion of the leg 134 is removed at 135 to provide access to the ventilation openings 82 in the side panel 52.

The door 24 has a piano type hinge 146 with a plate 148 which overlies the side flange 144 of the front panel 22. Fastening means 150 such as screws or rivets can be used to secure the hinge plate 148 to the leg 142 of the hinge bracket 132, sandwiching the side flange 144 of the front panel 22 therebetween.

The hinge bracket 132 is fastened directly to the front panel 22 at the top and bottom by appropriate fastening means 152 such as rivets. The hinge bracket 132 is also fastened to the side panel 52 at a single upper location by an appropriate fastening means 154 such as a rivet. It has been found, surprisingly, that this single connection between the hinge bracket 134 and the side panel 52 provides adequate support for the door when fully extended to support a downward fifty pound force at the open edge of the door. Additional strengthening members and fastening means are not required. FIG. 14 also shows the outer wrapper 31 extending over the hinge connection area.

In FIGS. 13 and 5, it is seen that the side flange 144 of the front panel 22 has a central offset 155 between an upper point 156 and a lower point 158 which provides a clearance for the hinge plate 148 to nest into so that an outer surface of the hinge plate 148 is substantially coplanar with an outer surface of the side flange 144 above and below the recessed portion. This permits close fitting of the external wrapper 31 and prevents any unsightly gaps between the wrapper and the side flange 144 along the hinge area.

Thus, it has been shown that there is provided an improved microwave oven cavity and cabinet construction in which two U-shaped members are used to form the entirety of the cooking cavity and the cabinet. Special metal crimping and stitching techniques are used to provide a rigid radiation leak-proof cavity while avoiding any reworking or covering of the front panel. An effective, yet simple bracket is used to secure the door hinge to the oven cabinet thus resulting in a cavity and cabinet construction which makes efficient use of materials and does not require complex assembly techniques or procedures.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contributions to the art.

The embodiments of the invention in which an exclusive property or privilege is claimed are defined as follows:

1. A microwave oven cooking cavity and cabinet construction comprising:

a first U-shaped sheet metal member folded to form a front panel, bottom panel and rear panel of said oven cabinet as well as a bottom panel and rear panel of said cooking cavity;

said first member having an opening through said front panel portion forming a front opening for said cooking cavity;

a door member secured to said cabinet to selectively seal said front opening of said cooking cavity;

a second U-shaped sheet metal member nestable within said first member and folded to form a top panel and opposed side panels of said cooking cavity;

said second member top panel having a width less than a width of said first member bottom panel to provide a space laterally adjacent said cooking cavity in said cabinet to accommodate electrical components;

said second member having a flange formed along the entire peripheral edge thereof to lie flat against an adjacent portion of said first member;

fastening means for joining a portion of said second member flange to said front cabinet panel around the periphery of said cooking cavity opening resulting in metal-to-metal contact between said members while leaving a front face of said front panel unmarked; and fastening means for joining the remainder of said second member flange to adjacent cabinet panels resulting in metal-to-metal contact between said members;

whereby said cooking cavity is comprised of said two U-shaped members and being accessible through said front opening.

2. A microwave oven according to claim 1 including a flange formed around said cooking cavity opening in said first member wherein said fastening means for joining a portion of said second member flange to said front cabinet panel comprises a crimped connection between said second member flange and said first member flange.

3. A microwave oven according to claim 2 wherein said portion of said second member flange has a plurality of equally spaced holes therethrough and corresponding depressions are formed in said first member flange after said first member flange has been crimped over said second member flange such that said first member flange is securely locked to said second member flange.

4. A microwave oven according to claim 3 wherein microwave energy having a specific wavelength is to be used in said microwave oven and said second member flange holes are spaced no more than ¼th of said wavelength apart.

5. A microwave oven according to claim 1 wherein said fastening means for joining said remainder of said second member flange to adjacent cabinet panels comprises a plurality of metal stitches between said second member flange and said adjacent cabinet panels.

6. A microwave oven according to claim 5 wherein microwave energy having a specific wavelength is to be used in said microwave oven and said metal stitches are spaced no greater than ¼th of said wavelength apart.

7. A microwave oven according to claim 1 wherein said side panels have shelf support shoulders formed therein spaced a short distance above a bottom edge of said side panels.

8. A microwave oven according to claim 1 wherein said second member side panels have a height less than a height of said first member front and rear panels to provide a space above said cooking cavity within said cabinet.

9. A microwave oven cooking cavity and cabinet construction comprising:

a first U-shaped sheet metal member folded to form a front panel, bottom panel and rear panel of said oven cabonet as well as a bottom panel and rear panel of said cooking cavity;

said first member having an opening through said front panel portion forming a front opening for said cooking cavity;

a door member securable to said cabinet to seal said front opening of said cooking cavity;

a second U-shaped sheet metal member nestable within said first member and folded to form a top panel and opposed side panels of said cooking cavity;

a hinge bracket formed as a U-shaped channel with a bottom portion lying against said front panel and one upstanding leg lying against and adjacent one of said side panels;

said front panel having a side flange extending rearwardly of said front panel;

said hinge plate overlying said front panel side flange and sandwiching said flange between said plate and a second upstanding leg of said hinge bracket;

said hinge bracket being attached to said front panel and said adjacent side panel;

said second U-shaped member having a flange formed along the entire peripheral edge thereof to lie flat against an adjacent portion of said first member;

fastening means for joining a portion of said second member flange to said front cabinet panel around the periphery of said cooking cavity opening resulting in metal-to-metal contact between said members while leaving a front face of said front panel unmarked; and fastening means for joining the remainder of said second member flange in metal-to-metal contact between said members;

whereby said cooking cavity is comprised of said two U-shaped members and being accessible through said front opening.

10. A microwave oven according to claim 9 wherein said hinge bracket channel bottom portion is stepped to provide a clearance area for said second member flange and fastening means adjacent the periphery of said cooking cavity.

11. A microwave oven according to claim 9 wherein said hinge bracket is secured to said front panel at only two places, near opposite ends of said channel.

12. A microwave oven according to claim 9 wherein said hinge bracket is secured to said adjacent side panel at only one location.

13. A microwave oven according to claim 9 in which said front panel side flange has a central recessed portion to receive said hinge bracket whereby an outer face of said hinge bracket is flush with an outer face of said side flange.

14. A generally rectangular microwave oven cooking cavity and cabinet construction of six panels each comprising:

a first U-shaped sheet metal member folded to form three panels of said oven cabinet as well as three panels of said cooking cavity;

said first member having an opening through one panel portion, being a front panel, forming an opening for said cooking cavity;

a door member secured to said cabinet to selectively seal said opening of said cooking cavity;

a second U-shaped sheet metal member nestable within said first member and folded to form the remaining three panels of said cooking cavity;

said second member being dimensionally smaller than said first member to provide a space adjacent said cooking cavity in said cabinet;

said second member having a flange formed along the entire peripheral edge thereof to lie flat against an adjacent portion of said first member; and fastening means for joining said second member flange to adjacent first member panels resulting in a metal-to-metal contact between said members while leaving a front face of said front panel unmarked;

whereby said cooking cavity is comprised of said two U-shaped members and being accessible through said front opening.

15. A microwave oven according to claim 14 wherein said second member is dimensionally smaller than said first member in two perpendicular directions to provide space adjacent two sides of said cooking cavity in said cabinet.

16. A microwave oven according to claim 14 including a flange formed around said cooking cavity opening in said first member wherein said fastening means for joining a portion of said second member flange to said front cabinet panel comprises a crimped connection between said second member flange and said first member flange.

17. A microwave oven according to claim 16 wherein said portion of said second member flange has a plurality of equally spaced holes therethrough and corresponding depressions are formed in said first member flange after said first member flange has been crimped over said second member flange such that said first member flange is securely locked to said second member flange.

18. A microwave oven according to claim 17 wherein microwave energy having a specific wavelength is to be used in said microwave oven and said second member flange holes are spaced no more than $\frac{1}{4}$th of said wavelength apart.

19. A microwave oven according to claim 16 wherein said fastening means for joining said remainder of said second member flange to adjacent cabinet panels comprises a plurality of metal stitches between said second member flange and said adjacent cabinet panels.

20. A microwave oven according to claim 19 wherein microwave energy having a specific wavelength is to be used in said microwave oven and said metal stitches are spaced no greater than $\frac{1}{4}$th of said wavelength apart.

21. A microwave oven according to claim 14 wherein said first member panel portion defining said opening further defines a flat panel portion which surrounds said opening and wherein said fastening means establishes metal-to-metal contact between said second member flange and said flat panel portion while leaving said flat panel portion unmarked and uninterrupted.

* * * * *